US005684263A

United States Patent [19]

Lace

[11] Patent Number: 5,684,263

[45] Date of Patent: Nov. 4, 1997

[54] ELECTROMAGNETIC SENSOR ASSEMBLY FOR MUSICAL INSTRUMENTS HAVING A MAGNETIC LINING

[75] Inventor: Jeffrey J. Lace, Huntington Beach, Calif.

[73] Assignee: Actodyne General, Inc., Huntington Beach, Calif.

[21] Appl. No.: 486,319

[22] Filed: Jun. 7, 1995

Related U.S. Application Data

[63] Continuation-in-part of Ser. No. 231,115, Apr. 22, 1994, Pat. No. 5,464,948.

[51] Int. Cl.[6] ..... G10H 3/18

[52] U.S. Cl. ..... 84/726

[58] Field of Search ..... 84/723, 725–728

[56] References Cited

U.S. PATENT DOCUMENTS

| | | |
|---|---|---|
| Re. 32,520 | 10/1987 | Lace . |
| 2,089,171 | 8/1937 | Beauchamp . |
| 2,119,584 | 6/1938 | Knoblaugh . |
| 2,175,325 | 10/1939 | Sunshine . |
| 2,209,016 | 7/1940 | Dickerson . |
| 2,294,861 | 9/1942 | Fuller . |
| 2,445,046 | 7/1948 | Tinkham . |
| 2,557,754 | 6/1951 | Morrison . |
| 2,567,570 | 9/1951 | McCarty . |
| 2,573,254 | 10/1951 | Fender . |
| 2,612,541 | 9/1952 | DeArmond . |
| 2,683,388 | 7/1954 | Keller . |
| 2,725,778 | 12/1955 | Cronwell . |
| 2,764,052 | 9/1956 | McBride . |
| 2,817,261 | 12/1957 | Fender . |
| 2,892,371 | 6/1959 | Butts . |
| 2,896,491 | 7/1959 | Lover . |
| 2,909,092 | 10/1959 | De Armond et al. . |
| 2,911,871 | 11/1959 | Schultz . |
| 2,968,204 | 1/1961 | Fender . |
| 2,976,755 | 3/1961 | Fender . |
| 3,066,567 | 12/1962 | Kelley, Jr. . |
| 3,183,296 | 5/1965 | Miessner . |
| 3,236,930 | 2/1966 | Fender . |
| 3,249,677 | 5/1966 | Burns et al. . |
| 3,290,424 | 12/1966 | Fender . |
| 3,417,268 | 12/1968 | Lace . |
| 3,483,303 | 12/1969 | Warner . |
| 3,530,228 | 9/1970 | Scherer . |
| 3,535,968 | 10/1970 | Rickard . |
| 3,541,219 | 11/1970 | Abair . |
| 3,571,483 | 3/1971 | Davidson . |
| 3,588,311 | 6/1971 | Zoller . |
| 3,602,627 | 8/1971 | McCammon . |
| 3,657,461 | 4/1972 | Freeman . |
| 3,668,295 | 6/1972 | Broussard . |
| 3,711,619 | 1/1973 | Jones et al. . |
| 3,715,446 | 2/1973 | Kosinski . |
| 3,725,561 | 4/1973 | Paul . |
| 3,902,394 | 9/1975 | Stich . |
| 3,911,777 | 10/1975 | Rendell . |
| 3,916,751 | 11/1975 | Stich . |
| 3,962,946 | 6/1976 | Rickard . |
| 3,983,777 | 10/1976 | Bartolini . |
| 3,983,778 | 10/1976 | Bartolini . |
| 3,992,972 | 11/1976 | Rickard . |
| 4,010,334 | 3/1977 | Demeter . |
| 4,026,178 | 5/1977 | Fuller . |
| 4,050,341 | 9/1977 | Underwood . |
| 4,056,255 | 11/1977 | Lace . |
| 4,096,780 | 6/1978 | Dawson . |
| 4,133,243 | 1/1979 | DiMarzio . |
| 4,138,178 | 2/1979 | Miller et al. . |
| 4,145,944 | 3/1979 | Helpinstill, II . |
| 4,184,399 | 1/1980 | Zuniga . |

(List continued on next page.)

*Primary Examiner*—William M. Shoop, Jr.
*Assistant Examiner*—Jeffrey W. Donels
*Attorney, Agent, or Firm*—Bliss McGlynn, P.C.

[57] ABSTRACT

A sensor assembly for a stringed musical instrument having a plurality of movable strings includes a case having a longitudinal channel, a magnetic lining disposed in the longitudinal channel, at least one coil disposed in the longitudinal channel, and at least one secondary magnet disposed in the longitudinal channel between the magnetic lining and the coil.

20 Claims, 3 Drawing Sheets

U.S. PATENT DOCUMENTS

| | | |
|---|---|---|
| 4,188,849 | 2/1980 | Rickard . |
| 4,220,069 | 9/1980 | Fender . |
| 4,222,301 | 9/1980 | Valdez . |
| 4,261,240 | 4/1981 | Aaroe . |
| 4,268,771 | 5/1981 | Lace . |
| 4,269,103 | 5/1981 | Underwood . |
| 4,283,982 | 8/1981 | Armstrong . |
| 4,320,681 | 3/1982 | Altilio . |
| 4,364,295 | 12/1982 | Stich . |
| 4,372,186 | 2/1983 | Aaroe . |
| 4,378,722 | 4/1983 | Isakson . |
| 4,379,421 | 4/1983 | Nunan . |
| 4,394,830 | 7/1983 | Damiano . |
| 4,433,603 | 2/1984 | Siminoff . |
| 4,442,749 | 4/1984 | DiMarzio et al. . |
| 4,463,648 | 8/1984 | Fender . |
| 4,472,994 | 9/1984 | Armstrong . |
| 4,499,809 | 2/1985 | Clevinger . |
| 4,501,186 | 2/1985 | Ikuma . |
| 4,524,667 | 6/1985 | Duncan . |
| 4,535,668 | 8/1985 | Schaller . |
| 4,545,278 | 10/1985 | Gagon et al. . |
| 4,580,481 | 4/1986 | Schaller et al. . |
| 4,581,974 | 4/1986 | Fender . |
| 4,624,172 | 11/1986 | McDougall . |
| 4,632,003 | 12/1986 | Kopp . |
| 4,738,178 | 4/1988 | Deering . |
| 4,809,578 | 3/1989 | Lace, Jr. . |
| 4,854,210 | 8/1989 | Palazzolo . |
| 4,869,144 | 9/1989 | Lieber . |
| 4,872,386 | 10/1989 | Betticare . |
| 4,878,412 | 11/1989 | Resnick . |
| 4,885,970 | 12/1989 | Fender . |
| 4,911,054 | 3/1990 | McClish . |
| 4,941,389 | 7/1990 | Wendler . |
| 4,949,619 | 8/1990 | Frieherr von Maltzan . |
| 5,012,716 | 5/1991 | Pagelli . |
| 5,027,691 | 7/1991 | Kennedy . |
| 5,041,784 | 8/1991 | Griebeler . |
| 5,111,728 | 5/1992 | Blucher et al. . |
| 5,148,733 | 9/1992 | Beller . |
| 5,168,117 | 12/1992 | Anderson . |
| 5,189,241 | 2/1993 | Nakamura . |
| 5,221,805 | 6/1993 | Lace . |
| 5,252,777 | 10/1993 | Allen . |
| 5,290,968 | 3/1994 | Mirigliano et al. . |
| 5,292,998 | 3/1994 | Knapp . |
| 5,292,999 | 3/1994 | Tumura . |
| 5,311,806 | 5/1994 | Riboloff . |
| 5,376,754 | 12/1994 | Stich . |
| 5,389,731 | 2/1995 | Lace . |
| 5,391,831 | 2/1995 | Lace . |
| 5,391,832 | 2/1995 | Lace . |
| 5,399,802 | 3/1995 | Blucher . |
| 5,408,043 | 4/1995 | Lace . |
| 5,422,432 | 6/1995 | Lace . |

FIG 4
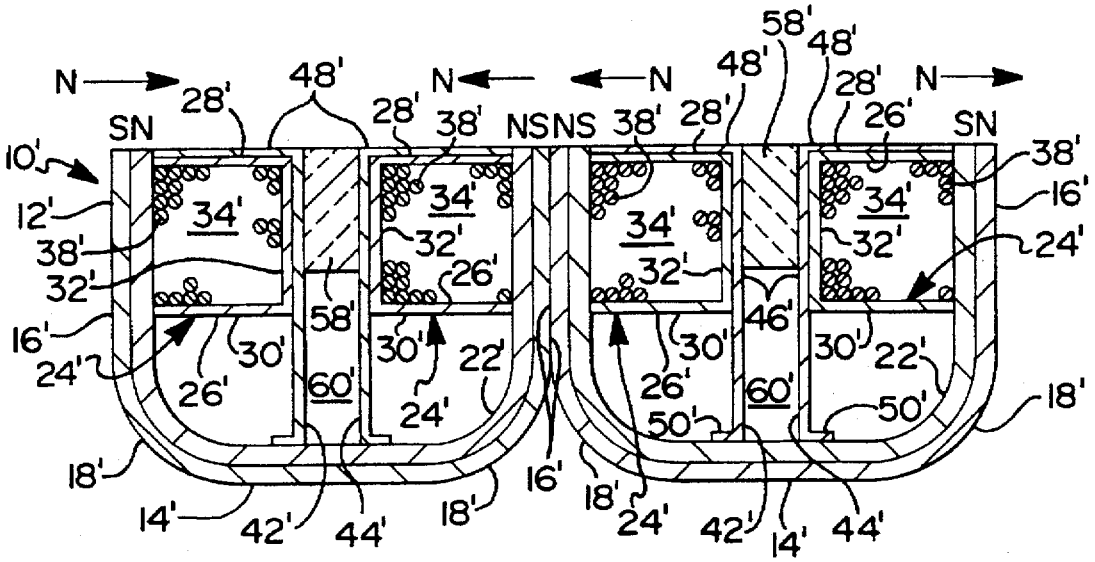
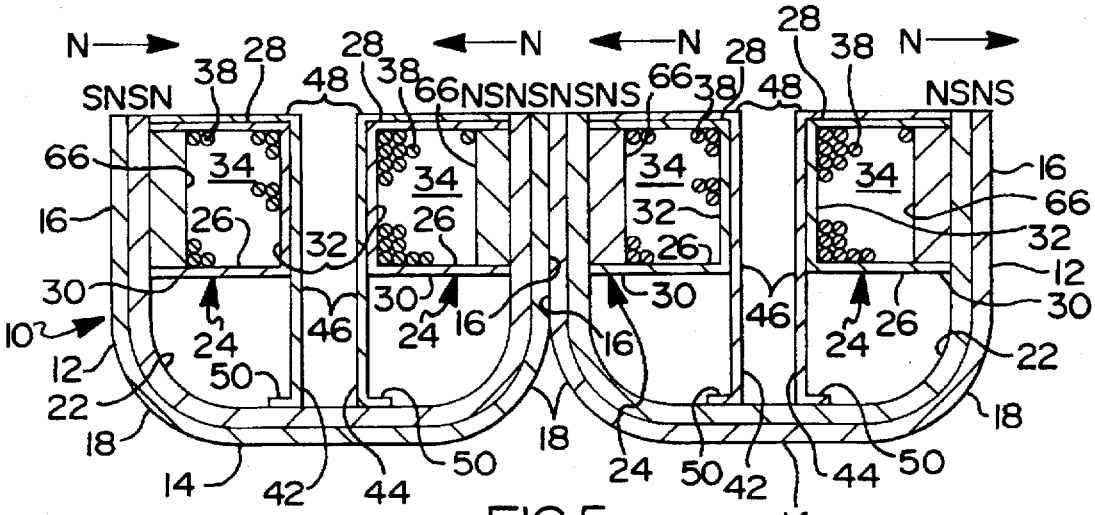
FIG 5

FIG 6
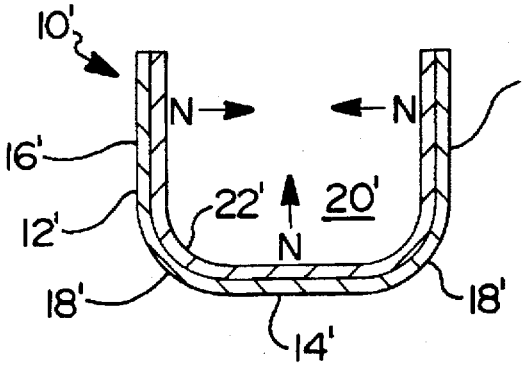
FIG 7
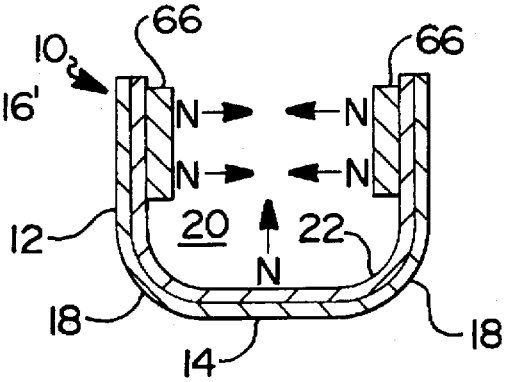
FIG 8
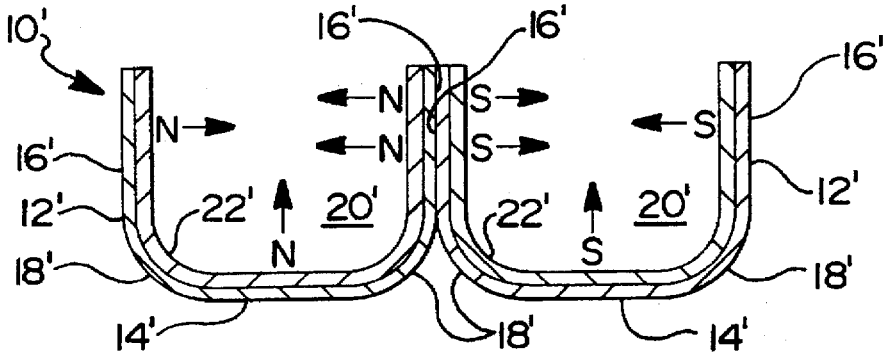
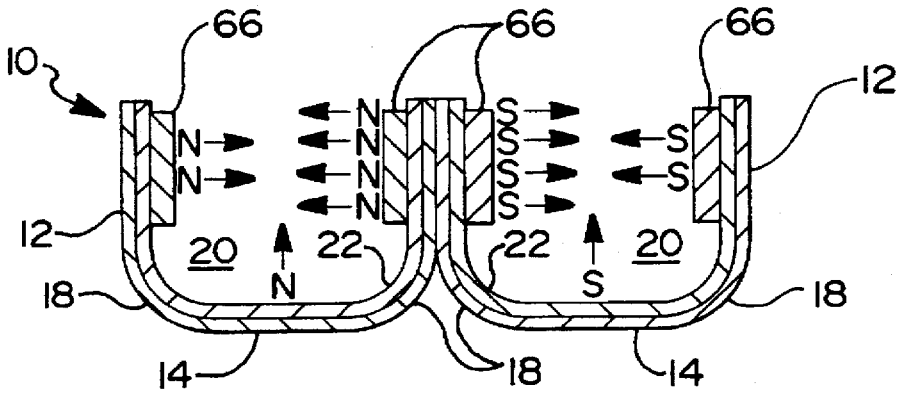
FIG 9

ELECTROMAGNETIC SENSOR ASSEMBLY FOR MUSICAL INSTRUMENTS HAVING A MAGNETIC LINING

CROSS-REFERENCE TO RELATED APPLICATION(S)

This application is a Continuation-In-Part of application U.S. Ser. No. 08/231,115, filed Apr. 22, 1994, now U.S. Pat. No. 5,464,948.

BACKGROUND OF THE INVENTION

1. Field of the Invention

The present invention relates generally to musical instruments and, more particularly, to a sensor assembly for use with stringed musical instruments.

2. Description of Related Art

Generally, stringed musical instruments such as electric guitars have electromagnetic sensors or pick-ups for sensing mechanical vibrations of electrically conductive strings and converting such vibrations into electrical signals. These electrical signals from the electromagnetic sensors are amplified, modified, and, ultimately, reconverted into acoustical energy for producing music and the like.

An example of such an electromagnetic sensor is disclosed in U.S. Pat. No. 4,809,578, issued Mar. 7, 1989, entitled "Magnetic Field Shaping an Acoustic Pick-up Assembly," the disclosure of which is hereby incorporated by reference. This patented sensor assembly includes an elongated ferromagnetic case lined on the interior thereof with planar permanent magnet pieces to present the same magnetic polarity into the interior thereof from each of the walls of the case. The patented sensor assembly also includes cores disposed in the interior of the case and having a plurality of coplanar, spaced, finger-like projections directed at the walls of the case. The walls and projections are permanently magnetized to a common magnetic polarity which will concentrate magnetic flux into gaps between the projections. The patented sensor assembly further includes a coil wound around the cores, wherein changes of these concentrated magnetic flux fields due to movement or vibration of the strings induces a voltage in the coil. The coil has terminals connected to a socket in the stringed musical instrument for connection to an amplifier and speaker system.

Although the above patented sensor assembly has worked well, it is typically more expensive to manufacture and assemble than conventional pick-ups. Moreover, musicians which play stringed musical instruments are desirous of having sensors which incorporate greater sensitivity of the full range of acoustic energy generated by the movement of such strings than conventional pick-ups. However, such greater sensitivity often requires a sensor which is more expensive to manufacture and assemble than conventional pick-ups. Thus, there is a need in the art to provide a sensor assembly which has greater sensitivity than conventional pick-ups and is less expensive to manufacture and assemble than current sensor assemblies.

SUMMARY OF THE INVENTION

It is, therefore, one object of the present invention to provide a sensor assembly for a stringed musical instrument.

It is another object of the present invention to provide a sensor assembly which has a greater sensitivity than conventional pick-ups.

To achieve the forgoing objects, a sensor assembly for a stringed musical instrument having a plurality of movable strings includes a case having a longitudinal channel. The sensor assembly also includes a magnetic lining disposed in the longitudinal channel and at least one coil disposed in the longitudinal channel. The sensor assembly further includes at least one secondary magnet disposed in the longitudinal channel between the magnetic lining and the coil.

One advantage of the present invention is that a sensor assembly is provided for a stringed musical instrument. Another advantage of the present invention is that the sensor assembly provides greater sensitivity than conventional pick-ups. Yet another advantage of the present is that the sensor assembly provides greater sensitivity over a larger range of frequencies. Still another advantage of the present invention is that the sensor assembly is less expensive to manufacture and assemble than current sensor assemblies.

Other objects, features and advantages of the present invention will be readily appreciated as the same becomes better understood after reading the subsequent description taken in conjunction with the accompanying drawings.

BRIEF DESCRIPTION OF THE DRAWINGS

FIG. 4 is a sectional view of another sensor assembly, according to the present invention, illustrated in a humbucker configuration with graphic representations of magnetic north and south.

FIG. 5 is a view similar to FIG. 2 with graphic representations of magnetic north and south.

FIG. 6 is a sectional view of the sensor assembly of FIG. 4 illustrated in a single configuration with portions removed and graphic representations of magnetic north.

FIG. 7 is a view similar to FIG. 3 with portions removed and graphic representations of magnetic north.

FIG. 8 is a view similar to FIG. 4 with portions removed and graphic representations of magnetic north and south.

FIG. 9 is a view similar to FIG. 5 with portions removed and graphic representations of magnetic north and south.

DESCRIPTION OF THE PREFERRED EMBODIMENT(S)

Figure 1:
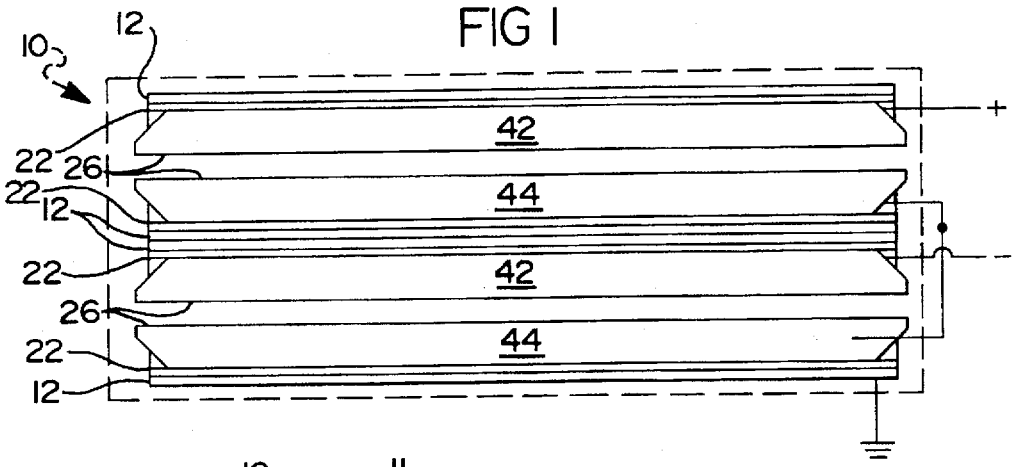
FIG. 1 is a top view of a sensor assembly, according to the present invention, illustrated in a humbucker configuration.
Figure 10:
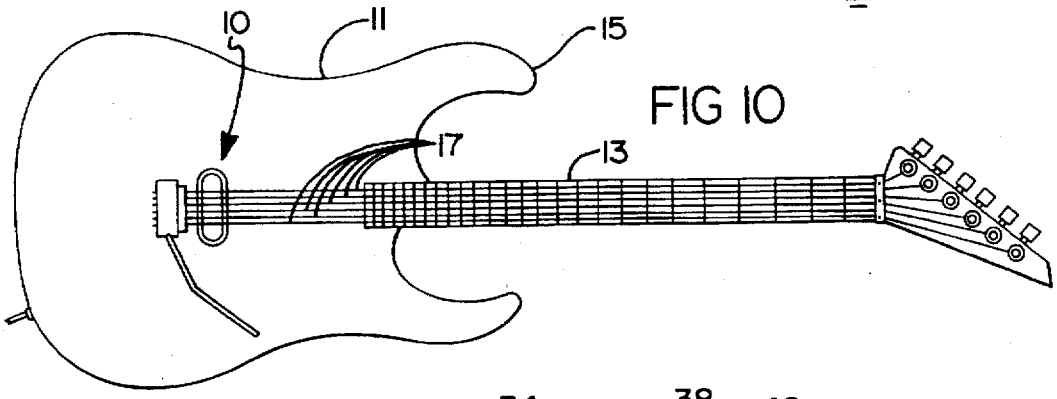
FIG. 10 is a top view of the sensor assembly, according to the present invention, attached to a stringed musical instrument.

Referring to FIGS. 1, 2, 5, 9 and 10, one embodiment of a sensor assembly, according to the present invention, is generally shown at 10 and in a humbucker configuration. The sensor assembly 10 is also shown in FIGS. 3, 6 and 7 in a single configuration. The sensor assembly 10 is operatively secured to a stringed musical instrument such as a guitar 11. The guitar 11 is of the electric type and has a neck portion 13, body portion 15, and a plurality of strings 17 extending along the neck portion 13 and body portion 15 as is known in the art. The sensor assembly 10 is disposed beneath the strings 17 and mounted to the body portion 15 by suitable means such as fasteners or adhesive as known in the art.

The sensor assembly 10 includes a case 12 extending longitudinally and having a general "U" shape cross-section.

The case 12 has a generally planar base wall 14 and a pair of generally planar side walls 16 substantially parallel to each other. Arcuate corner walls 18 connect the side walls 16 to the base wall 14 to form a longitudinal channel 20. The side walls 16 are substantially perpendicular to the base wall 14. Preferably, the longitudinal channel 20 has a lateral width greater than a height thereof. The case 12 is made as one-piece and from a ferromagnetic material such as an iron-based steel.

The sensor assembly 10 also includes a permanent magnet or magnetic lining 22 disposed in the longitudinal channel 20 and mounted to interior surfaces of the corner walls 18, side wall 16, and base wall 14 of the case 12 by suitable means such as an adhesive bonding agent. The permanent magnetic lining 22 is made of a flexible permanent magnetic material such as PLASTIFORM® which is commercially available from the 3M company of St. Paul, Minn. The permanent magnetic lining 22 extends longitudinally and is generally rectangular in shape. The permanent magnetic lining 22 is flexed into a generally U-shape and disposed in the longitudinal channel 20. The permanent magnetic lining 22 has a height near a height of the side wall 16.

When the permanent magnetic lining 22 is disposed adjacent the case 12, the permanent magnetic lining 22 presents a common magnetic polarity facing the interior of the longitudinal channel 20. In one embodiment, the permanent magnetic lining 22 is oriented such that its north magnetic polarity (N) is directed toward the interior of the longitudinal channel 20 and its south magnetic polarity (S) is directed outwardly toward the case 12. It should be appreciated that the permanent magnetic lining 22 can be arranged to present an opposite polarity as shown in a second sensor assembly 10 when the present invention is in a humbucker configuration as illustrated in FIGS. 1, 2, 5 and 9.

The sensor assembly 10 further includes at least one coil assembly, generally indicated at 24, disposed in the longitudinal channel 20 adjacent the permanent magnetic lining 22. The coil assembly 24 includes a bobbin 26 extending longitudinally and having a generally rectangular shape. The bobbin 26 is made of a plastic material such as nylon. The bobbin 26 has a generally planar top wall 28 and bottom wall 30 spaced vertically and generally parallel to each other. The corners of the top walls 28 and the bottom walls 30 may be chamfered. The bobbin 26 also has interior walls 32 generally perpendicular to the top walls 28 and the bottom walls 30 to form a recess 34 having a general "C" shape. The interior walls 32 are spaced laterally to form a generally rectangular space 36 extending through the top walls 28 and the bottom walls 30. The coil assembly 24 further includes a conductive wire 38, such as copper, wrapped or wound around the bobbin 26 and partially disposed in the recess 34 to form a coil 40°. It should be appreciated that the coil assembly 24 may extend longitudinally beyond the ends of the case 12.

The sensor assembly 10 also includes a pair of comb pieces 42 and 44 having a general inverted "L" shape. The comb pieces 42,44 are made of ferromagnetic material such as an iron-based steel. The comb pieces 42,44 have a leg portion 46 and an arm portion 48 extending generally perpendicular from an upper end of the leg portion 46 and a foot portion 50 extending generally perpendicular from a lower end of the leg portion 46. The leg portion 46 has a height greater than the lateral width of the arm portion 48. The arm portion 48 has a lateral width greater than the lateral width of the foot portion 50. The arm portion 48 also has a longitudinal length greater than the longitudinal length of the leg portion 46. The corners of the arm portion 48 are chamfered and may have a winding tab (not shown) extending outwardly from the chamfer. Each leg portion 46 has an aperture near each end of the connection to a lead 56. The leads 56 are connected to a socket (not shown) on the guitar 11 for connection to an amplifier and speaker system (not shown). It should be appreciated that the cases 12 are grounded through a ground lead 57.

The comb pieces 42,44 are spaced laterally and oriented in a back to back relationship. The leg portions 46 are disposed in the space 36 of the coil assembly 24 such that the foot portions 50 extend beyond the coil 40 and abut the permanent magnetic lining 22. The arm portions 48 are disposed over the coil 40 and adjacent the top wall 28 of the bobbin 26. It should be appreciated that the foot portions 50 increase the flux field for the sensor assembly 10.

Referring to FIG. 3, the sensor assembly 10 may include at least one insulating spacer 58 disposed in a space 60 between the comb pieces 42,44 such that the comb pieces 42,44 do not directly contact each other. The spacer 58 is generally rectangular in shape and made of a non-magnetic, non-conductive insulating material. The spacer 58 is of a sufficient width to press the comb pieces 42,44 against the coil assembly 24 which is, in turn, pressed against the permanent magnetic lining 22 and the case 12 to lock the comb pieces 42,44 and the coil assembly 24 into place within the channel 20. The comb pieces 42,44 may be grounded via self adhesive copper tape to the coil 40 and the case 12o Referring to FIGS. 2, 3, 5, 7, and 9, the sensor assembly 10 may include at least one, preferably a plurality of secondary magnets 66, which are disposed in the longitudinal channel 20 adjoining the permanent magnetic lining 22 in spaced relation from the side walls 16. More specifically, the secondary magnets 66 are bonded to the permanent magnetic lining 22 along the upper edges thereof directly adjacent the conductive wire 38 of the coil assembly 24. In this embodiment, the secondary magnets 66 extend from the top wall 28 to the bottom wall 30 of the bobbin 26. It should be appreciated that although a single secondary magnet 66 is shown adjacent each of the sides of the bobbin 26, a plurality of secondary magnets 66 may be used at each particular location.

Figure 2:
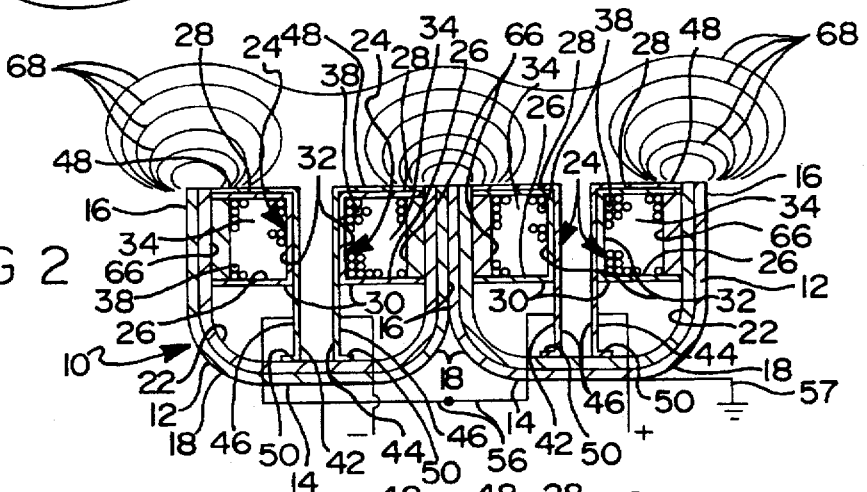
FIG. 2 is a sectional view of the sensor assembly of FIG. 1 with flux lines representing a magnetic field created by the sensor assembly.
Figure 3:
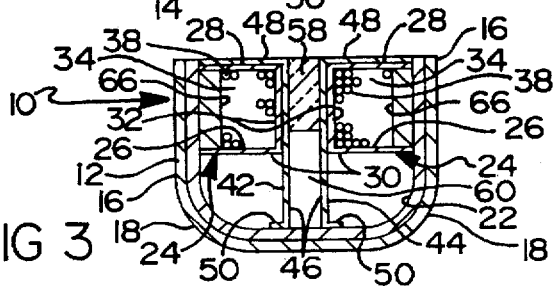
FIG. 3 is a sectional view of the sensor assembly, according to the present invention, illustrated in a single configuration.

Referring to FIG. 2, each of the secondary magnets 66 are oriented and positioned such that the magnetic fields created by the permanent magnetic lining 22 and the secondary magnets 66 are constructive. As illustrated in FIGS. 2, 5, 7 and 9, graphic representation of the magnetic flux lines 68 and magnetic fields illustrates the secondary magnets 66 are positioned and aligned such that their respective magnetic fields add to magnetic fields created by the permanent magnetic lining 22 in such a manner as to create a stronger magnetic field. This stronger magnetic field increases the output of the sensor assembly 10 as compared to the sensor assembly 10 in FIGS. 4, 6 and 8 which lack the secondary magnets 66.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A sensor assembly for a stringed musical instrument having a plurality of movable strings comprising:

a case having a longitudinal channel;

a primary magnet disposed in said longitudinal channel;

at least one coil disposed in said longitudinal channel; and at least one secondary magnet disposed in said longitudinal channel between said primary magnet and said at least one coil.

2. A sensor assembly as set forth in claim 1 wherein said primary magnet is a flexible permanent magnetic strip.

3. A sensor assembly as set forth in claim 2 wherein said permanent magnetic strip is rectangular in shape.

4. A sensor assembly as set forth in claim 1 wherein said case extends longitudinally and has a "U" shape.

5. A sensor assembly for a stringed musical instrument having a plurality of movable strings comprising:

a case having a longitudinal channel;

a magnetic lining disposed in said longitudinal channel;

at least one coil disposed in said longitudinal channel; and a plurality of secondary magnets positioned in said longitudinal channel between said magnetic lining and said at least one coil such that magnetic fields created by said magnetic lining and said secondary magnets are constructively added.

6. A sensor assembly for a stringed musical instrument having a plurality of movable strings comprising:

a case having a longitudinal channel;

a magnetic lining disposed in said longitudinal channel;

at least one coil disposed in said longitudinal channel;

at least one secondary magnet disposed in said longitudinal channel between said magnetic lining and said at least one coil; and a plurality of comb pieces disposed within said coil for locking said coil within said longitudinal channel.

7. A sensor assembly as set forth in claim 6 including a spacer disposed between said comb pieces and made of a non-conductive, non-magnetic insulating material.

8. A sensor assembly for a stringed musical instrument having a plurality of movable strings comprising:

a case including a base wall and at least two side walls extending outwardly from said base wall, said base wall and said side walls forming a longitudinal channel;

a magnetic lining disposed in said longitudinal channel along said base wall and said side walls;

at least one coil disposed in said longitudinal channel; and a plurality of secondary magnets disposed in said longitudinal channel and adjacent said magnetic lining and adjacent said at least one coil such that magnetic fields created by said magnetic lining and said secondary magnets are constructively added.

9. A sensor assembly as set forth in claim 8 wherein said at least one coil comprises a bobbin extending longitudinally and spaced laterally and wire wrapped around said bobbin.

10. A sensor assembly as set forth in claim 8 including a plurality of comb pieces disposed within said at least one coil and a spacer disposed between said comb pieces.

11. A sensor assembly as set forth in claim 10 wherein each of said comb pieces have a leg portion and an arm portion extending perpendicular to said leg portion.

12. A sensor assembly as set forth in claim 11 wherein said arm portion has a longitudinal length greater than a longitudinal length of said leg portion.

13. A sensor assembly as set forth in claim 11 wherein said leg portion has a height greater than a height of said coil and greater than a lateral width of said arm portion.

14. A sensor assembly as set forth in claim 11 wherein said arm portion has a plurality of longitudinally spaced teeth.

15. A sensor assembly as set forth in claim 10 wherein said spacer is made of a non-conductive, non-magnetic insulating material.

16. A sensor assembly as set forth in claim 8 wherein said magnetic lining is rectangular in shape.

17. A sensor assembly as set forth in claim 8 wherein said case extends longitudinally and has a U-shape.

18. A sensor assembly as set forth in claim 8 wherein said case has an arcuate base wall and a pair of planar side walls parallel to each other to form said longitudinal channel.

19. A sensor assembly as set forth in claim 8 wherein said secondary magnets are rectangular in shape.

20. A sensor assembly for a stringed musical instrument having a plurality of movable strings comprising:

a case including a base wall and at least two side walls extending outwardly from said base wall, said base wall and said side walls forming a longitudinal channel;

a magnetic lining disposed in said longitudinal channel along said base wall and said side walls;

at least one coil disposed in said longitudinal channel and having a bobbin extending longitudinally and spaced laterally and wire wrapped around said bobbin and a plurality of comb pieces disposed within said at least one coil; and a plurality of secondary magnets disposed in said longitudinal channel and adjacent said magnetic lining and adjacent said at least one coil such that magnetic fields created by said magnetic lining and said second magnets are constructively added.

* * * * *

UNITED STATES PATENT AND TRADEMARK OFFICE

CERTIFICATE OF CORRECTION

PATENT NO. : 5,684,263

DATED : November 4, 1997

INVENTOR(S) : Jeffrey J. Lace

It is certified that error appears in the above-indentified patent and that said Letters Patent is hereby corrected as shown below:

Column 3, line 53, delete "40°" and insert therefor --40--.

Column 4, line 29, delete "12$_{\circ}$" and insert therefor --12.--.

Signed and Sealed this

Twenty-fourth Day of February, 1998

*Attest:*

Bruce Lehman

BRUCE LEHMAN

*Attesting Officer*

*Commissioner of Patents and Trademarks*